United States Patent [19]

Baier et al.

[11] Patent Number: 4,461,238

[45] Date of Patent: Jul. 24, 1984

[54] MAGNETIC BRUSH DEVELOPING STATION

[75] Inventors: Erich Baier, Suenzhausen; Rainer Koefferlein, Munich; Bernhard Schlageter, Ottobrunn, all of Fed. Rep. of Germany

[73] Assignee: Siemens Aktiengesellschaft, Berlin & Munich, Fed. Rep. of Germany

[21] Appl. No.: 375,456

[22] Filed: May 6, 1982

[30] Foreign Application Priority Data

May 13, 1981 [DE] Fed. Rep. of Germany ..... 3119010

[51] Int. Cl.[3] ..... G03G 15/09

[52] U.S. Cl. ..... 118/658; 355/3 DD

[58] Field of Search ..... 355/3 DD, 14 D; 118/652, 653, 656, 657, 658, 602, 612; 222/DIG. 1

[56] References Cited

U.S. PATENT DOCUMENTS

| | | | |
|---|---|---|---|
| 3,333,566 | 8/1967 | Kent | 355/3 DD |
| 3,664,299 | 5/1972 | Shaler et al. | 118/657 X |
| 3,882,821 | 5/1975 | Katayama et al. . | |
| 3,883,240 | 5/1975 | Ito et al. . | |
| 3,912,388 | 10/1975 | Takahashi et al. | 355/3 DD |
| 4,026,241 | 5/1977 | Takebe et al. | 355/3 DD X |
| 4,075,977 | 2/1978 | Williams | 118/658 |

*Primary Examiner*—J. V. Truhe
*Assistant Examiner*—J. Pendegrass
*Attorney, Agent, or Firm*—Hill, Van Santen, Steadman & Simpson

[57] ABSTRACT

In a developer station for an electrophotographic printing or copying machine, there is provided apparatus which affords effective intermixing of carrier and toner particles in the developer mix and which enables the developer mix to be removed from the station prior to replacement in an automatic and simplified fashion. Transport and developer rollers are mounted in the station for conducting developer mix from a supply chamber to communication with a charge image carrier. A pair of rotary screws are disposed in the station on one side of the rollers with conveyance directions opposite to one another for conducting developer mix back and forth through the station enabling fresh toner to blend into the developer mix and maintaining uniform mixing of toner and carrier particles of the mix. On the other side of the developer roller from the mixing screws, there is provided a guide plate assembly which receives developer mix spilled off the top of the developer drum after passing by the image carrier and conducts this spilled-off mix laterally through the housing toward one end of the housing. At this one end of the housing there is provided a discharge opening in the housing floor underlying the flow communication between the first screw receiving the fresh toner and the second screw disposed in the main body mix supply chamber. Overlying the discharge opening and extending between a stripper means acting upon the developer roller and the discharge opening is a discharge plate which serves to conduct stripped away developer mix particles into the discharge opening. For removal of developer mix from the station, particles are conveyed by the mixing screws, the developer and transport rollers, the guide plate assembly, and the discharge plate until substantially all of the developer mix contained in the station is passed into the discharge opening.

6 Claims, 2 Drawing Figures

MAGNETIC BRUSH DEVELOPING STATION

RELATED APPLICATIONS

This application concerns subject matter which relates to the following commonly assigned U.S. patent applications, all filed May 6, 1982:

Ser. No. 375,458 entitled "Device For The Development Of Charge Images, Which Are Arranged On A Charge Image Carrier, With The Aid Of A Developing Mixture Consisting Of Toner And Carrier Particles" and Ser. No. 375,457 entitled "Device For Adjusting The Level Of A Developing Mixture Which Consists Of Toner And Carrier Particles On A Developing Roller."

BACKGROUND OF THE INVENTION

The invention relates to apparatus for use in developer station where charge images formed on a charge image carrier passed through the developer station are inked in accordance with magnetic brush principles with a developer mix of toner and carrier particles.

Typically, non-mechanical printing or copying machines function according to electrophotographic or xerographic principles, wherein electrostatic latent images of characters to be printed are generated on a charge image carrier, such as a photoconductive drum, and subsequently inked with a black powder known as toner in a developing station. The toner images are subsequently transferred to sheet paper on which they are fixed. The developing station typically includes at least one developer unit generally referred to in the art as a magnetic brush developer. The magnetic brush developer, as a rule, contains a magnetic drum mounted for rotation so as to continually bring developer mix, consisting of iron carrier particles and toner particles, into contact with the electrostatic images recorded on the charge image carrier. The charge images are inked by adherence of toner particles to the charge images due to electrostatic forces. The magnetic drum conventionally comprises a rotating hollow cylinder with a stationary magnet arrangement mounted within. A plurality of magnetic drum arrangements may be disposed in a developer station. Typical developer station assemblies which function in accordance with magnetic brush principles are disclosed in U.S. Pat. Nos. 3,882,821 and 3,883,240. In addition to the magnetic drum, there may also be disposed in the developer station a magnetic transport roller disposed for rotation between a main body supply of developer mix and the developer roller for conducting developer mix particles to the developer roller for transport to the image carrier.

In the development of charge images, the maintenance of an effective toner concentration in the developer mix is necessary for a uniform and efficacious printing of the charge image characters. Accordingly, a fresh supply of toner particles must be periodically or continuously added to the developer mix contained in the developer station and the fresh toner must be added at a substantially even rate. In this regard, it is known to utilize rotary mixing screws disposed in the developer station to continuously distribute the toner and carrier particles of the mix and blend in fresh toner added to the main body of mix to make up for toner spent in the charge image inking process. Such a mixing screw arrangement is disclosed in U.S. Pat. No. 3,883,240.

Despite the continuous addition of fresh toner to the developer mix, the tribo-electrical characteristics of the carrier particles deteriorate over time and the developer mix becomes no longer adequately useable and has to be replaced. It is desirable that the replacement of developer mix be capable of being carried out rapidly without requiring cumbersome additional machinery or adjustments of the developer station in order to minimize assembly costs and downtime.

An object of the present invention is to provide a developer station with apparatus such that the toner and carrier particles are continuously blended in the developer mix to promote even inking of the carrier charge images. A further object of the present invention is to provide particle mix apparatus such that removal of developer mix from the developer station is possible rapidly and without requiring expensive additional machinery.

SUMMARY OF THE INVENTION

In a developer station for an electrophotographic printing or copying machine, there is provided a housing containing at least one developer roller by which developer mix particles are conducted upwardly from the housing floor to an inking gap between the charge image carrier passing through the developer station and the developing roller. Disposed within the housing are two spaced-apart, parallel extending rotary mixing screws for the continuous mixing and transport of toner and carrier particles and for blending fresh toner into the mix. The first mixing screw is disposed adjacent the floor of the station housing within a main body of developer mix adjacent the developer roller. On the other side of the first mixing screw from the developer roller, there is disposed a slot opening in the floor of the station housing. The second mixing screw is arranged in a supply chamber separated from the main body of mix by a suitable partition wall and located on the other side of the slot opening from the first mixing screw. The supply chamber receives fresh toner at one end which is conducted to the other end by the second screw for passage through a supply opening formed in the chamber partition wall and deposit in the vicinity of the pick-up end of the first screw.

Beneath the developer roller there is disposed a rotary transport roller which conducts developer mix from the main body to the developer roller. Unused developer particles passing through the inking gap are spilled off the upper end of the developer roller in a direction away from the station area containing the first and second mixing screws. Situated adjacent the developer roller downstream of the inking gap and on the other side of the developer roller from the first screw is a vertically extending guide wall member which serves to direct developer mix spilling off the developer roller onto the transport roller for recycling to the developer roller. The guide wall member preferably comprises a series of diagonally extending guide plates disposed parallel to one another and lined up along the longitudinal length of the developer roller.

A discharge plate is arranged overlying the slot opening and beneath a rotary stripping roller, which is arranged to level the layer thickness of developer mix being conducted on the developer roller to the inking gap. The stripping roller rotates in a direction corresponding to the direction of rotation of the developer roller for directing excess developer mix being conducted on the developer roller radially away from the developer roller toward the slot opening. Some of this excess developer mix being acted upon by the stripping roller drops back onto the main body of mix and the remaining part is passed onto the discharge plate from which it drops off into the slot opening for removal from the developer station.

Separating plates are disposed between the main body of mix and the transport and developer rollers.

DESCRIPTION OF THE PREFERRED EMBODIMENT

Figure 1:
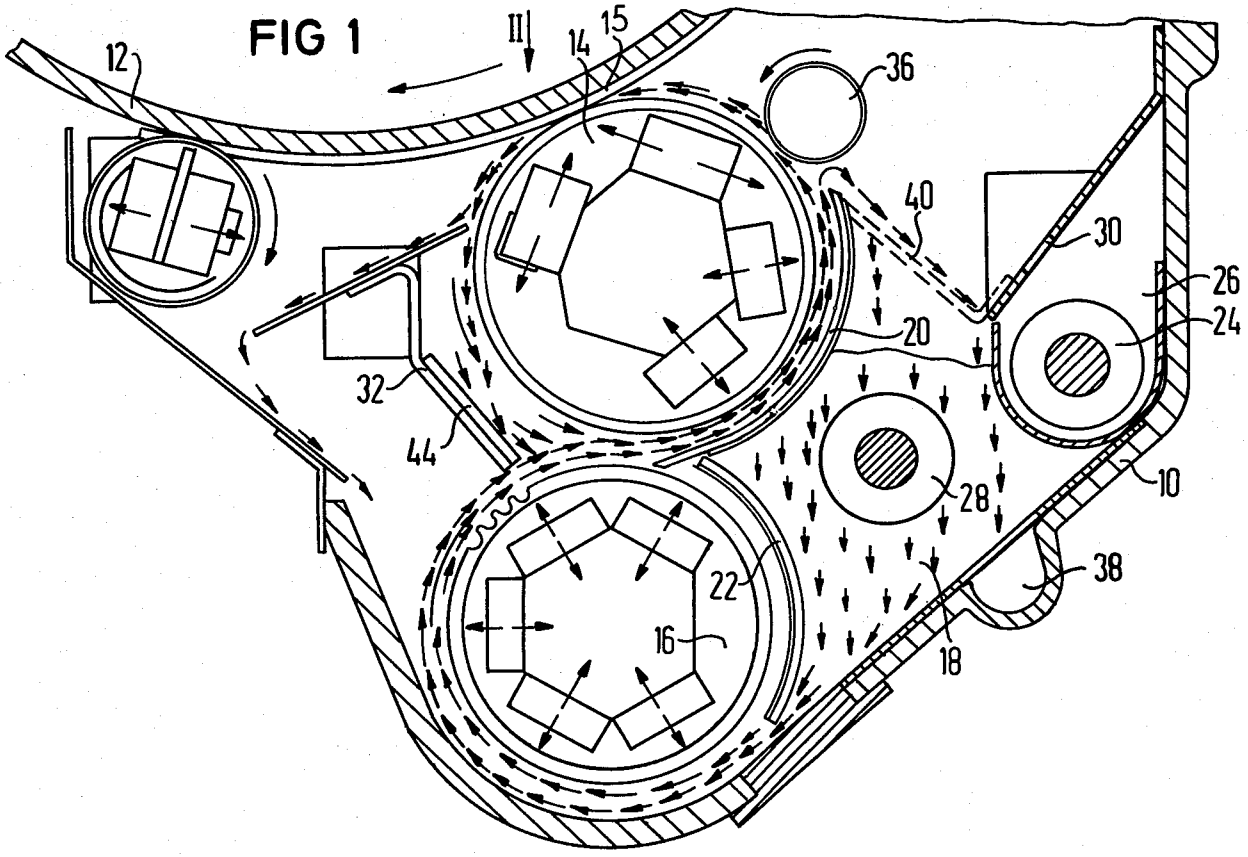
FIG. 1 is a schematic, side elevational cross-sectional view of a developer station constructed in accordance with the present invention.
Figure 2:
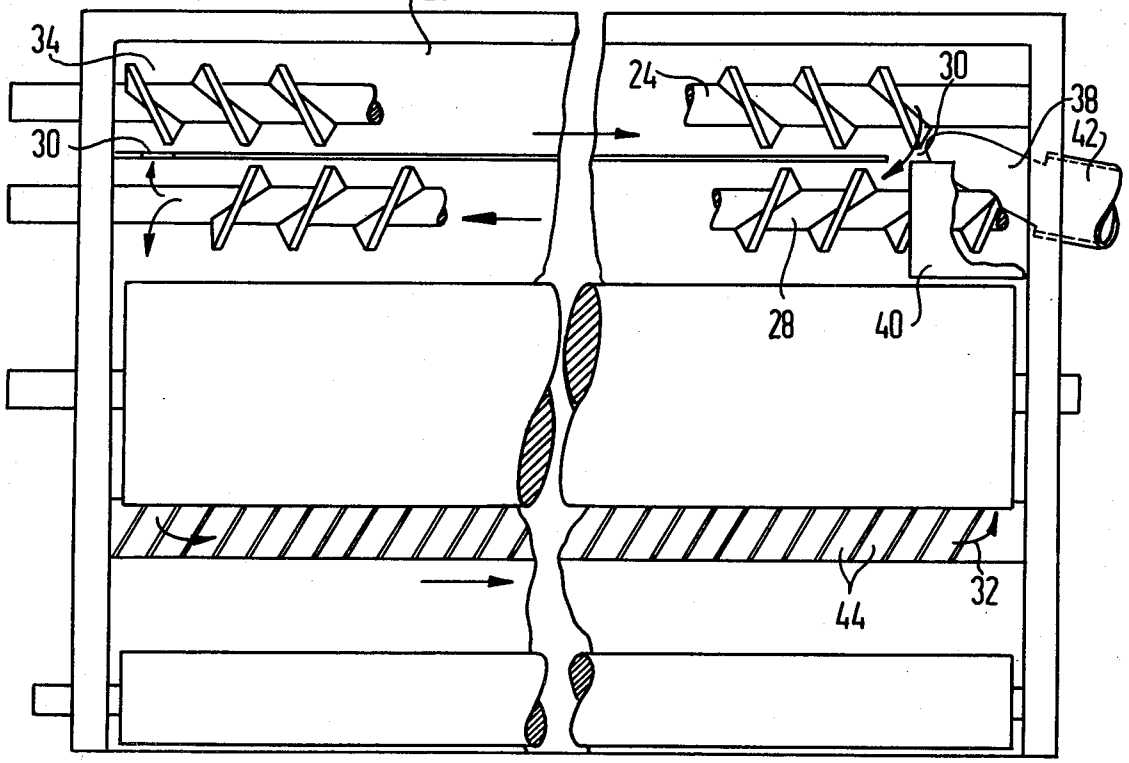
FIG. 2 is a fragmentary plan view taken in the direction II shown in FIG. 1 of the developer station of FIG. 1.

FIGS. 1 and 2 illustrate a developer station 10 for use in an electrophotographic printing or copying machine. A charge image carrier 12 in the form of a photoconductive drum is mounted for rotation in the machine in the direction indicated by the arrow for conducting charge images from suitable charging stations (not shown) to the developer station 10 for inking, and then to suitable transfer and cleaning stations (not shown). The developer station 10 is formed of a housing in which is mounted a developer drum or roller 14, which may be of conventional construction, for rotation to conduct developer mix particles, consisting of toner and iron carrier particles, from a lower region of the housing to an inking gap 15 formed between the developer drum 14 and the charge image carrier 12 in the direction of the arrows shown. The developer drum 14 comprises, for example, a rotating hollow cylinder and a stationary, fixed magnet assembly which is arranged inside the hollow cylinder. Beneath the developer drum 14, there is mounted a transport roller 16. The transport roller is disposed for rotation within the lower region of the developer station for conducting developer mix particles from a chamber area 18 containing a main body supply of mix along the floor of the developer station to the developer drum 14. The transport roller 16 is conventionally of a type comprising a rotating hollow cylinder having an annularly etched surface with a fixed magnet arrangement disposed therein. The transport roller and the developer drum operate in accordance with magnetic brush principles.

The developer drum 14 and the transport roller 16 are separated from the mix chamber 18 by adjacent disposed plates 20 and 22, respectively, for preventing the main body of mix from interfering with the operation of the drum and roller. The lower plate disposed adjacent the transport roller 16 has a lower end spaced over the floor of the station housing to permit a flow of developer mix to pass from the supply chamber 18 into transport engagement with the roller 16 for feeding to the developer drum 14.

For continuous mixing of the toner and carrier particles and distribution of the developer mix within the developer station, there is provided a first rotary screw 24 disposed in a mixing chamber 26 adjacent one sidewall of the station housing and longitudinal with the developer drum 14 and a second rotary screw 28 disposed within the supply chamber 18 with a longitudinal axis parallel to that of the first screw 24. As shown in FIG. 1, the mixing chamber 26 along with its rotary screw 24 is located in the developer station at a level elevated from the second screw 28 and a communication opening 30 formed in the partition wall dividing the mixing chamber from the supply chamber 18, as shown in FIG. 2, serves to permit particle flow communication between the mixing chamber and the supply chamber. In addition, a wall member overlying the mixing chamber 26 is formed with an opening means 30 such that, when the supply chamber is filled to a high level with developer mix, the mix can escape from the supply chamber 18 into the mixing chamber 26.

The mixing chamber 26 is adapted to receive a supply of fresh toner particles at a region 34 adjacent to the inlet or lead end of the rotary screw 24. The fresh toner particles are then conveyed in the direction of the arrow shown in FIG. 2 through the mixing chamber toward the discharge end of the screw 24 at the opposed end of the station housing whereupon the fresh toner passes through the communication opening 30 into the supply chamber 18. The fresh toner supplied through the opening 30 passes onto the main body of mix in the supply chamber 18 adjacent the lead or inlet end of the rotary screw 28. The rotary screw 28 serves to conduct developer mix particles in the direction of the arrow shown in FIG. 2 through the supply chamber 18, whereby the fresh toner is thoroughly intermixed into the main body of developer mix.

Developer mix is then conducted from the supply chamber by the transport roller 16 in the direction of the arrows shown in FIG. 1 for pick up by the developer drum 14 which conducts developer mix to the inking gap 15 for development of charge images. The layer level of developer mix on the developer drum 14 is set to a desired uniform thickness in order to assure even printing quality of the charge images by means of a rotary stripping roller 36 disposed adjacent the developer drum 14. The stripping roller 36 rotates in a direction corresponding to the direction of rotation of the developer drum in order to conduct excess developer mix particles radially away from the drum for return to the supply chamber 18. The stripping roller 36 may have suitable mounting means for the roller journals which enable the position of the roller 36 to be radially adjusted relative to the adjacent surface of the developer drum 14.

Developer mix carried by the developer drum 14 which is not picked up by the charge image carrier 12 in the inking gap 15 spills off under the influence of gravity from the upper end of the drum 14 back toward the lower region of the station housing. This spill off occurs on the other side of the developer drum 14 from the supply and mixing chambers 18 and 26. Disposed adjacent this spill off side of the developer drum is a generally vertically extending guide plate means 32 for conducting spilled-off developer particles back onto the transport roller 16 for direct return to the developer drum 14. Passage of developer particles along the guide plate 32 also causes further intermixing of the particles being passed to the transport roller 16. The guide plate means 32 preferably comprises a series of individual guide plates 44 arranged parallel to one another in a longitudinal line along the length of the developer drum 14. The guide plates 44 run in a diagonal direction, as shown in FIG. 2, for promoting gradual movement of spilled off particles from one end of the housing adjacent the discharge point of the second screw 28 toward the other end of the housing each time the spilled off particles are again passed through the inking gap 15.

In order to remove developer mix from the developer station in an automatic fashion, there is provided a discharge outlet 38 disposed in the floor of the housing underlying the communication opening 30 and adjacent the inlet end of the second mixing screw 28. The opening 38 is provided with suitable valve means for opening and closing communication between the outlet 38 and supply chamber 18 and communicates out of the housing with a discharge pipe 42 through which removed mix particles are conducted, such as under the influence of gravity, to a suitable container.

A discharge plate 40 is disposed overlying the supply chamber 18 having an upper lead end beneath the stripping roller 36 for receiving excess mix particles stripped by the roller 36 away from the developer drum 14 and a lower tail end terminating over the discharge opening 38 so that, when the outlet 38 is opened, particles drop from the plate 40 into and through the discharge opening. The discharge plate 40 extends only a short distance along the longitudinal length of the developer drum 14 and the discharge opening 38 and discharge plate 40 are located adjacent the inlet end of the second screw 28 in the supply chamber 18.

When developer mix is to be removed from the developer station 10, the discharge outlet 38 is opened and the developer mix is conveyed through the developer station by movement of the rotary screws 24 and 28, the transport roller 16, and the developer drum 14 in the direction of the arrows shown in FIG. 2. Accordingly, the first mixing screw 24 transports developer mix from the mixing chamber 26 directly to the discharge outlet 38, which underlies the communication opening 30. The second mixing screw 28 serves to conduct developer mix along the length of the transport roller 16 toward its discharge end adjacent the opposite end of the station housing from the discharge opening 38. At the discharge end of the second screw 28, mix particles may build up to a level causing spillover through the opening 30 into the mixing chamber, whereupon these particles passing into the mixing chamber 26 are conveyed by the first screw 24 to the discharge opening 38. Meanwhile, in the supply chamber 18, the transport roller 16 serves to conduct developer mix to the developer drum 14. A portion of the developer mix being conducted by the developer drum 14 is continuously removed by the action of the stripping roller 36. Part of this stripped portion of the developer mix passes directly back into the supply chamber 18 while the remaining portion stripped off the developer drum adjacent the discharge outlet 38 passes onto the discharge plate 40 over which it is conducted for drop off into the discharge opening 38. The developer mix which remains on the developer drum 14 spills off at the inking gap 15 and is continuously laterally displaced by the diagonal arrangement of guide plates on the guide device 32 until these particles become disposed in the vicinity of the discharge plate 40 on the developer drum 14, whereupon the stripping roller action in this vicinity of the developer drum 14 serves to pass developer mix particles onto the discharge plate 40 and into the discharge outlet 38. In this manner of movement of developer mix particles through the developer station, the volume of developer mix in the supply chamber 18 becomes gradually reduced until very little of the developer mix remains in the station housing.

By virtue of the present invention construction, a developer station assembly is provided that affords very good intermixing of toner and carrier particles in a developer mix and enables the developer station to be automatically and easily emptied of developer mix prior to replacement without requiring extensive or cumbersome auxiliary devices.

Although various minor modifications may be suggested by those versed in the art, it should be understood that we wish to embody within the scope of the patent warranted hereon all such modifications as reasonably and properly come within the scope of our contribution to the art.

We claim as our invention:

1. In a developer station having a housing containing a body of developer mix including toner and carrier particles in a supply zone and a rotary developer drum for conducting developer mix from said body to an inking gap between said developer drum and a charge image carrier passing through said station for developing charge images generated on said carrier, apparatus for handling developer mix in said station comprising:

first and second parallel arranged rotary screws extending longitudinally of said developer drum for conducting developer mix in opposite directions laterally in said housing, said second screw being between said first screw and developer drum, a partition wall separating said first and second screws having an opening connecting the discharge end of said first screw with the inlet end of said second screw, a discharge outlet means underlying said opening, and means for passing developer mix from said developer drum to said discharge outlet means comprising a stripping means adjacent said developer drum for setting a uniform layer thickness for the developer mix conducted by said drum to said inking gap and discharging excess developer mix from said developer drum to said supply zone and a discharge plate means mounted between said stripping means and said discharge outlet means for transferring a portion of said excess developer mix to said discharge outlet means.

2. The apparatus of claim 1, wherein said stripping means comprises a roller mounted for rotation in a direction corresponding to the direction of rotation of said developer drum.

3. The apparatus of claim 1, said means for passing further comprising a guide means adjacent said developer drum for receiving developer mix passing through said inking gap, returning the developer mix back to said developer drum, and continuously conducting received developer mix along the length of said developer drum to that part of said drum across from said discharge plate means.

4. The apparatus of claim 3, wherein said guide means comprises a downwardly extending wall made up of a plurality of parallel diagonally directed plates.

5. The apparatus of claim 3, further comprising a transport roller disposed for rotation beneath said developer drum for transporting developer mix from said supply zone to said developer drum, said guide means conducting received developer mix onto said transport roller.

6. The apparatus of claim 1, further comprising separation wall means between said developer drum and said supply zone.

* * * * *